US011273890B2

(12) United States Patent
Culp

(10) Patent No.: US 11,273,890 B2
(45) Date of Patent: Mar. 15, 2022

(54) LIFE JACKET WITH INTEGRATED SLEEVES

(71) Applicant: The Coleman Company, Inc., Wichita, KS (US)

(72) Inventor: Yiyun Culp, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 16/630,623

(22) PCT Filed: Jun. 7, 2018

(86) PCT No.: PCT/US2018/036399
§ 371 (c)(1),
(2) Date: Jan. 13, 2020

(87) PCT Pub. No.: WO2019/013908
PCT Pub. Date: Jan. 17, 2019

(65) Prior Publication Data

US 2020/0130790 A1 Apr. 30, 2020

Related U.S. Application Data

(60) Provisional application No. 62/530,987, filed on Jul. 11, 2017.

(51) Int. Cl.
*B63C 9/115* (2006.01)

(52) U.S. Cl.
CPC ..... *B63C 9/115* (2013.01)

(58) Field of Classification Search
CPC ..... B63C 9/08; B63C 9/115
See application file for complete search history.

(56) References Cited

U.S. PATENT DOCUMENTS 2,629,118 A * 2/1953 Frieder ..... B63C 9/115 441/110
3,266,069 A * 8/1966 O'Link ..... B63C 9/115 441/107

(Continued)

FOREIGN PATENT DOCUMENTS

JP 62164900 U 12/1977
KR 1020070035681 A 4/2007

OTHER PUBLICATIONS

International Search Report and Written Opinion dated Sep. 27, 2018.

*Primary Examiner* — Stephen P Avila
(74) *Attorney, Agent, or Firm* — Husch Blackwell LLP

(57) ABSTRACT

A life jacket vest including a life jacket member having a pair of arm openings and a lining having a pair of sleeve members and a perimeter. The lining is positioned in mating relationship with at least a portion of the life jacket member and is attached along at least a portion of the perimeter of the life jacket member. The sleeve members are received and extend through the openings of the life jacket member and are not attached to the life jacket member. The life jacket member may include a fastener member and a size adjustment member. The lining may include a neck portion and a collar portion. By attaching the lining to the life jacket member in places other than the arm openings, the present life jacket vest allows for a greater range of motion and less constraints in the arm openings of the life jacket member.

20 Claims, 5 Drawing Sheets

(56) References Cited

U.S. PATENT DOCUMENTS

| | | | | |
|---|---|---|---|---|
| 5,588,892 | A * | 12/1996 | McMahon | B63C 9/115<br>441/116 |
| 7,059,924 | B2 * | 6/2006 | Farmer | A41D 13/0125<br>441/106 |
| 2006/0099864 | A1 * | 5/2006 | Crumrine | B63C 9/08<br>441/106 |
| 2011/0009020 | A1 * | 1/2011 | Withers | B63C 9/1255<br>441/118 |
| 2016/0295937 | A1 * | 10/2016 | Harrington | A41D 19/0006 |
| 2016/0317846 | A1 | 11/2016 | Murray et al. | |

* cited by examiner

LIFE JACKET WITH INTEGRATED SLEEVES

CROSS-REFERENCE TO RELATED APPLICATIONS

This application claims priority to PCT Application No. PCT/US2018/036399, filed 7 Jun. 2018, which itself claims priority to U.S. Provisional Patent Application 62/530,987, filed 11 Jul. 2017, the entirety of both of which are hereby incorporated by reference.

FIELD OF THE INVENTION

The present invention relates to a life jacket vest and, more specifically, to a life jacket vest with integrated sleeves and optional neck.

BACKGROUND

Millions of children partake in water activities each year, and are kept safe through a variety of flotation devices. Some of the most common flotation devices are arm bands and life jackets. However both of these flotation devices have their disadvantages. Life jackets offer better protection and are able to keep a child's head out of the water, but children may not like wearing life jackets because they are uncomfortable. Arm bands, on the other hand, do not offer the same type of protection as life jackets. Instead, arm bands serve more as a support or an instructional aid while a child is learning how to swim. If a child is injured or incapacitated, arm bands will not keep a child's head out of the water. Additionally, children can easily remove the arm bands themselves.

While life jackets and arm bands enable flotation, neither life jackets nor arm bands offer sun protection, particularly to the arms and neck of the wearer. Clothing, such as rash guards, does offer sun protection, but cannot serve as a flotation device. Efforts have been made to create a device that offers both flotation and protection against the sun by attaching sleeves to a life jacket. However, simply attaching sleeves to a life jacket results in a very uncomfortable rash guard shirt or a very restrictive life jacket.

It is therefore desirable to create a flotation device that does not restrict arm or neck movement, protects against the sun, and keeps an incapacitated child's head out of the water.

SUMMARY OF THE INVENTION

The present invention described herein is a life jacket vest with an integrated neck and sleeves, wherein the life jacket vest allows for greater mobility in the arm area and provides protection from the sun. The present life jacket vest includes both a life jacket member and a lining. The life jacket member is a life jacket as known and understood in the art. While the lining has a front, rear, sides, sleeve members, and a neck portion, the lining may differ according to the preferences of the consumer. For example, the lining may or may not have a neck portion, with or without a collar. The lining may also be fabricated in various lengths and include sleeve members of varying lengths as well.

The sleeves members of the present lining are inserted and extend through the arm apertures of the life jacket member. The sleeves members are not attached to the life jacket member. Instead, in one embodiment, the lining is attached to the life jacket member along at least a portion of its perimeter, such as along or adjacent to a fastener member.

This secures the life jacket member to the lining. The lining may be attached to the life jacket member in other places, such as at the neck, along side portions or around other perimeter locations of the life jacket member. The lining, attached to the life jacket member in places other than the arm apertures, allows for a greater range of motion and less constraints in the arm openings. The lining is also preferably made of ultraviolet-blocking fabric. The present life jacket vest with integrated sleeves and a neck is therefore a comfortable flotation device that also offers protection from the sun.

BRIEF DESCRIPTION OF THE DRAWINGS

For a better understanding of the various embodiments of the present invention, reference may be made to the accompanying drawings in which.

Figure 1:
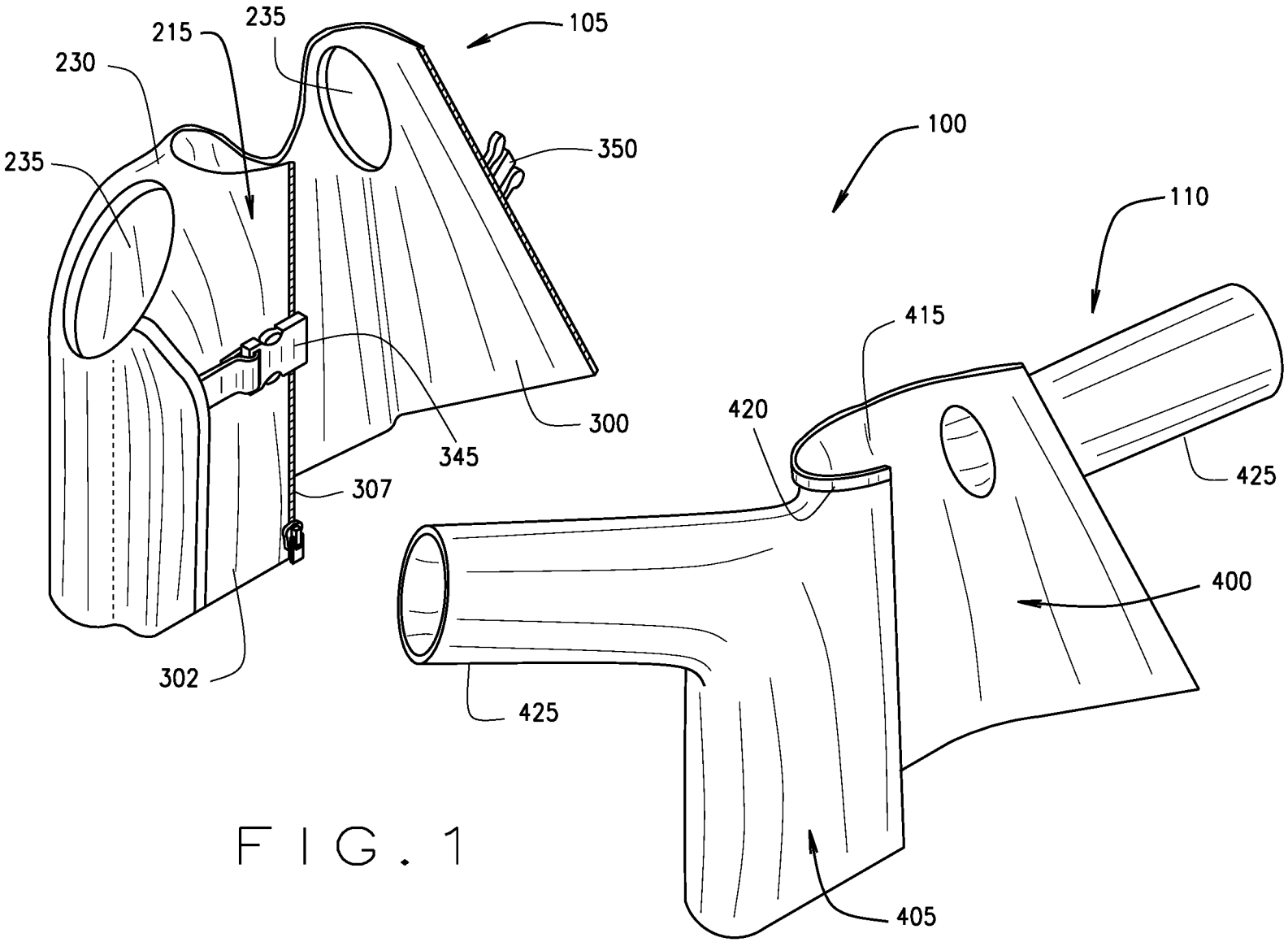
FIG. 1 is an exploded perspective view of a life jacket vest with integrated neck and sleeves constructed in accordance with the teachings of one embodiment of the present invention in its open state.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiments disclosed, but on the contrary, the intention is to cover all modifications, equivalents, and alternatives falling within the spirit and scope of the present disclosure.

DETAILED DESCRIPTION OF THE INVENTION

The present invention will now be described with reference to the drawing figures in which like reference numerals refer to like parts throughout this disclosure. For purposes of clarity in illustrating the characteristics of the present invention, proportional relationships of the elements have not necessarily been maintained in the drawing figures.

Figure 2:
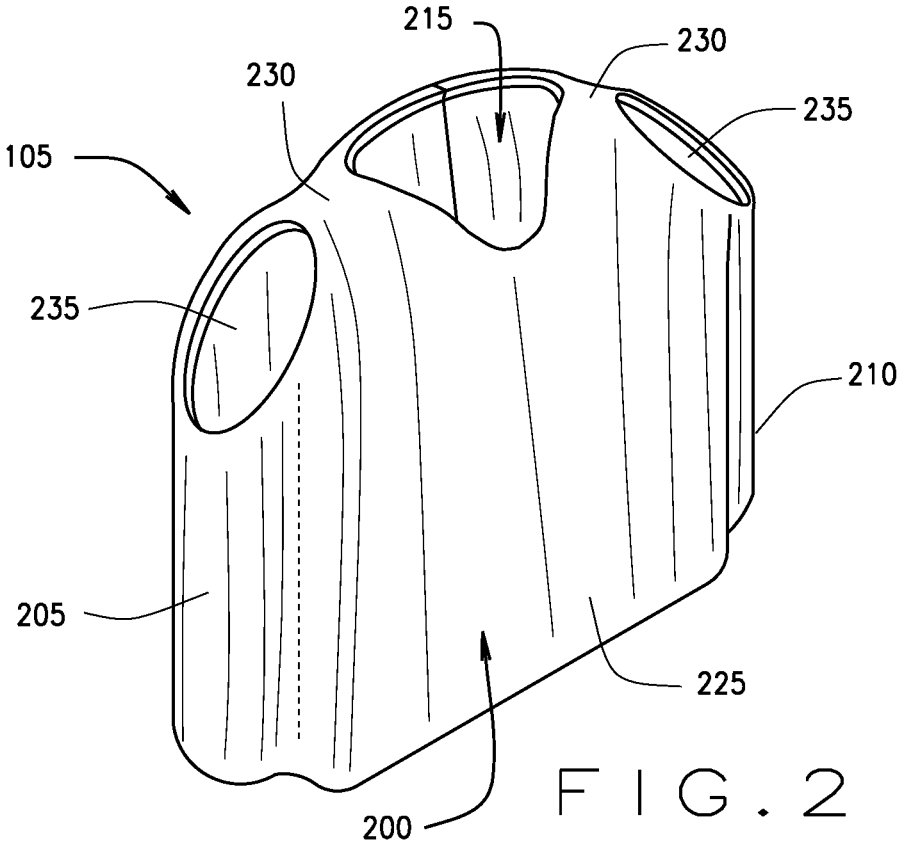
FIG. 2 is a perspective front view of the life jacket member of FIG. 1 in its closed state.
Figure 3:
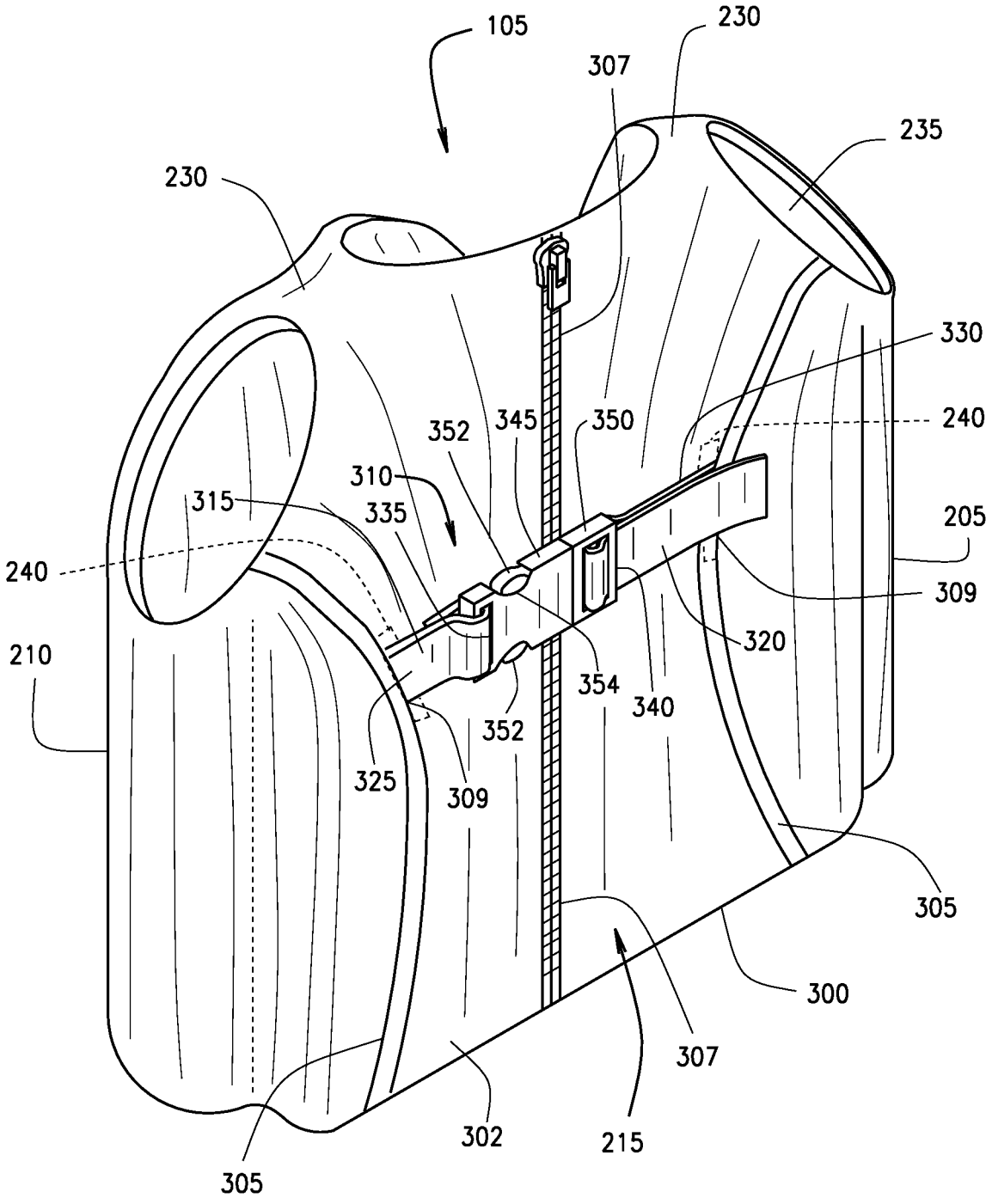
FIG. 3 is a perspective rear view of the life jacket member of FIGS. 1 and 2 in its closed state.

As illustrated in FIG. 1, a life jacket vest with integrated neck and sleeves 100 includes a life jacket member 105 and a lining 110 which will be described in more detail below. As been illustrated in FIG. 2, life jacket member 105 is a typical life jacket vest as known and understood in the art. Life jacket member 105 includes a front section 200, two side sections 205 and 210, and a rear section 215. Front section 200 includes an upper front portion 220 and a lower front portion 225. Front section 200 and rear section 215 are located opposite from one another, while opposed side sections 205 and 210 are located adjacent to both front section 200 and rear section 215. Strap portions 230 are located and positioned above the upper front portion 220 of the front section 200 of life jacket member 105 and extend from upper front section 220 to the rear section 215 as illustrated in FIGS. 2 and 3. Life jacket member 105 further includes a pair of arm apertures or openings 235 located approximately adjacent strap portions 230, adjacent and above upper front portion 220 of front section 200, and adjacent and above side sections 205 and 210. Arm apertures 235 are substantially oval in shape and are constructed to receive the arms of a wearer such that the arm of a wearer can extend through each arm aperture 235 and freely rotate and move therewithin. It is recognized and anticipated that the arm apertures 235 may be positioned and located in other areas of life jacket member 105 relative to strap portions 230 and upper front portion 220 depending upon the size of the wearer.

At least front section 200 and rear section 215 include a material that is less dense than water, a buoyant material, thereby enabling a wearer that dons the life jacket member 105 to float. In one embodiment, the buoyant material may reside in the interior portion or space associated with the front and rear sections 200 and 215. In an alternative embodiment, the entire front and rear sections may be made of a buoyant material. The straps portions 230 and side sections 205 and 210 can likewise include buoyant material. This material may be ethylene vinyl acetate, closed-cell foam, or foamed plastics, such as polyvinyl chloride and polyethylene. Other materials enabling buoyancy are envisioned and foreseeable. Life jacket member 105 preferably includes a nylon or polyester outer covering although other fabrics and materials are also envisioned.

As shown in FIG. 3, one embodiment of the present life jacket member 105 shows the rear section 215 split in half vertically into right rear side 300 and left rear side 302. In alternative embodiments, the rear section 215 may not be split in half. Instead, the vertical split may be located in front section 200, or along side sections 205 or 210, or at other locations.

Referring again to FIG. 3, right rear side 300 and left rear side 302 may each include a reinforcement member 305 that each runs from an arm aperture 235 to the bottom of the life jacket member 105. Reinforcement members 305 may include extra fabric material sewn to the rear section 215 or any other reinforcement type member to give strength and rigidity to the overall vest. Reinforcement members 305 may also curve inwardly, creating a slight arch as shown in FIG. 3. It is recognized and anticipated that reinforcement member 305 is not required and is merely an optional feature. The present life jacket member 105 can be fabricated without any type of reinforcement member.

Right rear side 300 and left rear side 302 of life jacket member 105 may likewise selectively engage each other through fastener member 307 thereby closing and securing the life jacket member around the wearer. Fastener member 307 may extend the full length of rear section 215, or it may extend only partially along the full length of rear section 215. In one embodiment, fastener member 307 is a zipper, although other fastener members such as Velcro® fasteners, buckles, buttons, ties, and still other methods and means of securing life jacket member 105 to the user are envisioned and foreseeable. Fastener member 307 may also include multiple methods and means of securing life jacket member 105 to the user. It is also recognized and anticipated that fastener member 307 may be positioned and located at other locations on life jacket member 105, including being relocated to front section 200 or to one of the side sections 205 or 210.

Life jacket member 105 may be further closed and secured to the wearer through the use of size adjustment member 310. In one embodiment, size adjustment member 310 is a strap or a long narrow piece of fabric which is located approximately between the upper and lower front portions 220 and 225 of the vest and runs horizontally around the entire life jacket member 105 and fastens or secures in the rear of the life jacket member 105 as illustrated in FIG. 3. In this regard, size adjustment member 310 may be embedded in the interior portion of front, side and rear sections 200, 205, 210 and 215 and may lie in-between the buoyant material and the fabric associated with the front section 200, side sections 205 and 210, and part of rear section 215. Size adjustment member 310 includes a first end portion 315 and a second end portion 320. First end portion 315 and second end portion 320 each further has a distal end 325 and 330 respectively, and a proximal end 335 and 340 respectively, both of which emerge from in-between the buoyant material and fabric of the life jacket member 105 at reinforcement member 305 on both the right rear side 300 and the left rear side 302 of the life jacket member 105. Although reinforcement members 305 may be permanently attached or otherwise fixed to life jacket member 305, size adjustment member 310 is not permanently attached. Instead, in one embodiment, reinforcement members 305, if they are used, are sewn onto life jacket member 105 such that a gap 309 exists in the seam attaching each reinforcement member 305 to life jacket member 105 where each distal end 325 and 330 of the size adjustment member 310 emerges from in-between the fabric and buoyant material.

The size adjustment member 310 can therefore be pulled back and forth around the life jacket member 105 without being impeded by reinforcement members 305. This is likewise true if reinforcement member 305 is not used.

The proximal ends 335 and 340 of first end portion 315 and second end portion 320 of the size adjustment member 310 are further attached to female receiver member 345 and male fastener member 350, respectively. Fastening members 345 and 350 are conventional type cooperatively engaging fasteners well known in the prior art. In operation, force is typically applied to the prongs 352 of the male fastener member 350 so that the prongs are inwardly depressed. The male fastener member 350 may then be inserted into the female receiver member 345. Once pressure is no longer applied to the prongs of the male fastener member 350, the prongs 352 return to their normal position, and extend through an opening 354 in the female receiver member 345, thereby securing the male fastener member 350 within female receiver member 345. When the male fastener member 350 is engaged with female receiver member 345, size adjustment member 310 further secures life jacket member 105 around the wearer. In order to disengage male fastener member 350 from female receiver member 345, the prongs 352 of male fastener member 350 are inwardly depressed and the male fastener member 350 withdrawn from female receiver member 345. The male fastener member 350 is therefore able to selectively engage with the female receiver member 345.

In order to tighten or loosen the fit of the life jacket member 105 around a particular wearer, the length of second end portion 320 of size adjustment member 310 may be adjusted thereby increasing or decreasing the length of size adjustment member 310 when female receiver member 345 and male fastener member 350 are engaged. Life jacket member 105 may be tightened by pulling proximal end 340 and moving male fastener member 350 closer to reinforcement member 305 on the right rear side 300 of life jacket member 105, thereby reducing the length of size adjustment member 310 when female receiver member 345 and male fastener member 350 are engaged. In order to loosen life jacket member 105, the male fastener member 350 can be moved away from reinforcement member 305 on the right rear side 300 of life jacket 105, thereby increasing the length of second end 320 and the overall length of size adjustment member 310.

It is also recognized and anticipated that size adjustment member 310 can likewise be relocated to other portions of the life jacket vest 100 so as to be compatible with fastening member 307. In other words, size adjustment member 310 can be moved to the same locations as fastening member 307 including being relocated to front section 200 or any one of the side sections 205 or 210. In this regard, if size adjustment member 310 is moved away from reinforcement member 305, or if reinforcement members 305 are not utilized in an alternative embodiment, size adjustment member 310 can be fed through an alternative opening or gap, such as opening 240, formed at the proper locations on life jacket member 105 as illustrated in dotted outline form in FIG. 3. Additionally, size adjustment member 310 can include multiple buckles, no buckles, or other methods of attachment, as well as being located in a different portion of the life jacket vest 100 other than where fastening member 307 is located. For example, other attachment mechanisms can also be used such as installing a zipper on the front or the back of the vest while attaching one buckle to each side of the vest. Also, the zipper can be eliminated by using only buckles. In alternative embodiments, size adjustment member 310 is optional, and a crotch strap may be installed instead. The crotch strap would connect to the life jacket vest 100, looped in-between the legs of the wearer, thereby further securing the life jacket vest 100 to the wearer. It is also recognized and anticipated that any number of fastening members and adjustment members can be utilized and located on life jacket vest 100 including on the front and/or rear portions of the vest.

Figure 4:
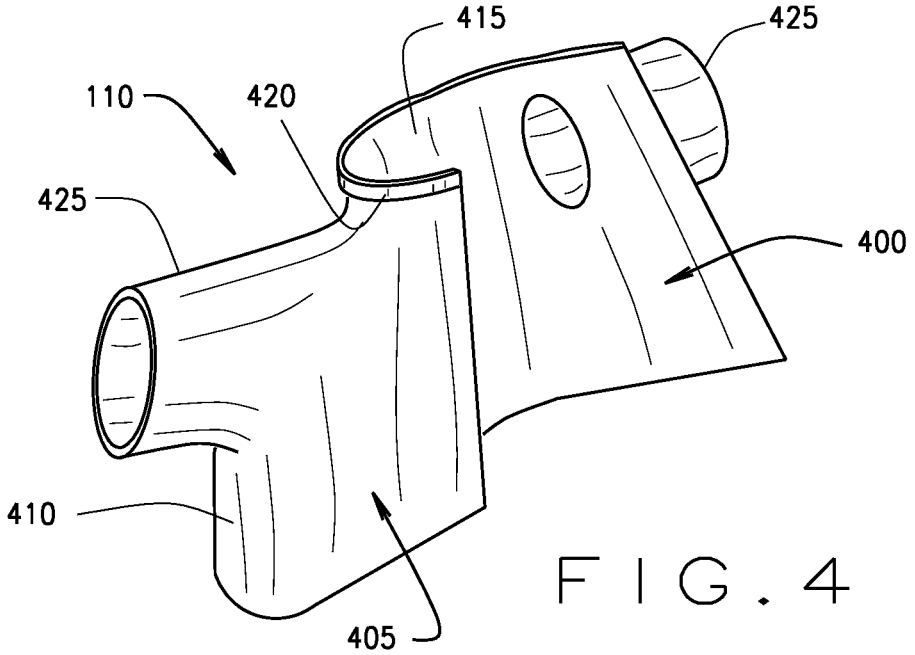
FIG. 4 is a perspective rear view of the lining of the life jacket vest of FIG. 1 in its open state.

Importantly, the lining 110 of the present life jacket vest 100 as best illustrated in FIG. 4 includes a lining front section 400, lining rear section 405, opposed lining side sections 410, a lining neck portion 415, a lining collar portion 420, and lining sleeve members 425.

Substantially similarly to the front section 200 of life jacket member 105, lining front section 400 is located also opposite to lining rear section 405 in its closed state and lining side sections 410 are located adjacent and in-between lining front and rear sections 400 and 405. Lining sleeve members 425 are located adjacent to both lining front section 400 and lining rear section 405. As shown in FIG. 6, when in its open state, lining 110 includes a top portion 401, a bottom portion 402A, or 402B, or 402C, and opposed side portions 403A, or 403B, or 403C depending upon the overall length of the lining 110 as will be hereinafter explained. Although lining sleeve members 425 are illustrated as being short-sleeved and lining 110 is cropped, it is recognized and anticipated that lining sleeve members 425 may be of different lengths ranging from short-sleeves as illustrated in FIGS. 4-8 to long-sleeves as illustrated in FIG. 1 according to the preferences of the consumer. Similarly, lining 110 may be cropped, hip-length, or any length in-between as will be hereinafter further explained. Lining 110 does not have to be a separate piece of fabric, but can instead be the covering of life jacket member 105, as described above, so as long as sleeve members 425 are not attached to the arm apertures 235. It is also recognized and anticipated that lining 110 and life jacket member 105 may be separate layers of fabric on the lining side of the life jacket vest 100.

As shown in FIG. 4, the neck portion 415 of lining 110 is positioned and located above front section 200 of life jacket member 105, and lining collar portion 420 is located above the lining neck portion 415. It is recognized and anticipated that the neck portion 415 can have various configurations such as a crew neck, turtle neck, V-neck, or other configuration. In alternative embodiments, the lining neck portion 415 and/or the lining collar portion 420 may be eliminated such that no integrated neck and/or color portion is associated with lining 110.

Lining 110 is preferably made out of a stretchy Ultraviolet Protection Factor (UPF) rated fabric thereby providing protection from the sun. Alternatively, the lining may be made out of a mesh material to increase air circulation. Additional materials used to create the lining are envisioned and foreseeable.

Figure 5:
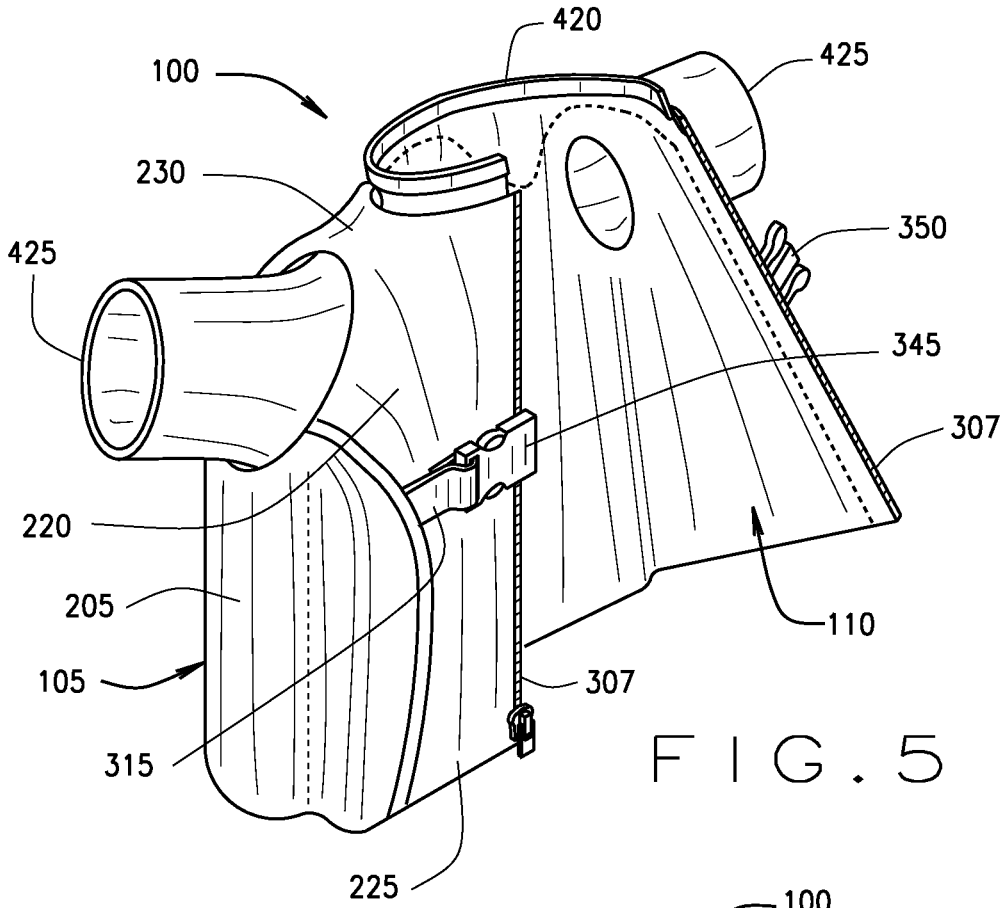
FIG. 5 is a perspective rear view of the assembled life jacket vest of FIG. 1 in its open state.
Figure 6:
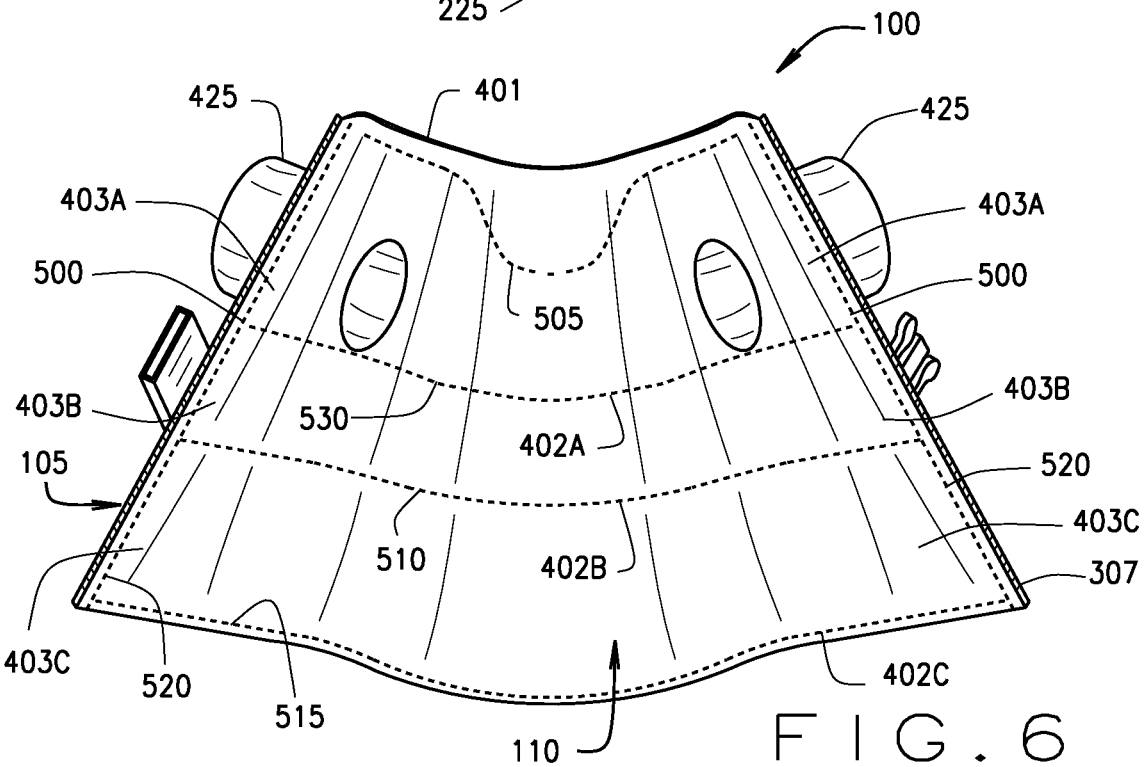
FIG. 6 is a perspective rear view of the life jacket vest of FIGS. 1 and 5 in its open state.

Turning to FIG. 5, lining 110 is incorporated into life jacket member 105 by inserting the lining sleeve members 425 of lining 110 into the arm apertures 235 of life jacket member 105. The lining sleeve members 425 extend through arm apertures 235 and the remaining portions of lining 110 are positioned in mating relationship with the corresponding portions of life jacket member 105 as best illustrated in FIG. 6. Once lining sleeve members 425 are inserted through arm apertures 235, the sleeve members 425 are not sewn or attached to arm apertures 235. Instead, the only area where the lining 110 needs to be attached to life jacket member 105 is along a portion of its perimeter such as along first seams 500. First seams 500 are located adjacent to upper front portion 220, alongside or adjacent to the fastener member 307 on opposite side portions of the life jacket member 105, and need not extend to lower portion 225 as shown in FIG. 6 and as will be hereinafter further explained.

It is important to note that lining 110 can be made of various lengths as shown by the dotted lines in FIG. 6. For example, lining 110 may be of a size and length as illustrated by dotted lines 500, 505 and 510 (half-length) or it can be of a size and length as shown by dotted lines 500, 505, 520 and 515 (full-length), or it can be of a size and length as shown by dotted lines 500, 505 and 530. In addition, any length lining 110 in-between full length (dotted line 515) and dotted line 530 is also recognized and anticipated including having a lining with only the sleeve members 425 associated therewith. Lining bottom portions 402A, or 402B, or 402C represent just some of the possible bottom portions of the overall lining 110 depending upon its overall length. In this regard, the lining 110 will mate with at least a portion of the life jacket member 105 depending upon its overall length.

While the only area that must be sewn to attach lining 110 to life jacket member 105 is, for example, at first seams 500, lining 110 may be attached to life jacket member 105 along other seams. For example, lining 110 may be attached to life jacket member 105 along second seam 505 which is located alongside the neck portion 415, adjacent to strap portions 230 and the uppermost piece of front section 200. Similarly, depending on the length of lining 110, lining 110 may also be attached at third seam 510, fourth seam 515, fifth seam 520 or sixth seam 530. It is also recognized and anticipated that lining 110 may only extend to seam 530 or seam 510 as previously indicated. The lining 110 could be attached along seams 500, 505, and 510. Third seam 510 is a horizontal seam located approximately between upper front portion 220 and lower front portion 225 of life jacket member 105.

Fourth seam 515 is also a horizontal seam, below third seam 510, and along the bottom perimeter of life jacket member 105. Fifth seams 520 are vertical seams, below first seams 500, adjacent to lower portion 225. Sixth seam 530 is another horizontal seam located below the lining sleeve members 425. Lining 110 may be attached to life jacket member 105 along any or all of the seams 500, 505, 510, 515, 520 and/or 530 depending upon its length. Other attachment points are likewise recognized and envisioned.

Since sleeve members 425 are only inserted into arm apertures 235, and not attached to life jacket 105, it minimizes constraints in the arm opening areas. The integrated sleeve members 425 therefore enhance the wearer's range of motion and are more comfortable to wear. It is also recognized and anticipated that the lining neck portion 415, if used, may likewise remain unattached to the upper front portion 220 of life jacket member 105, or lining neck portion 415 may be only partially attached to the upper front portion 220 of life jacket member 105 along seam 505 thereby also enhancing a wearer's range of motion in the neck area.

Figure 7:
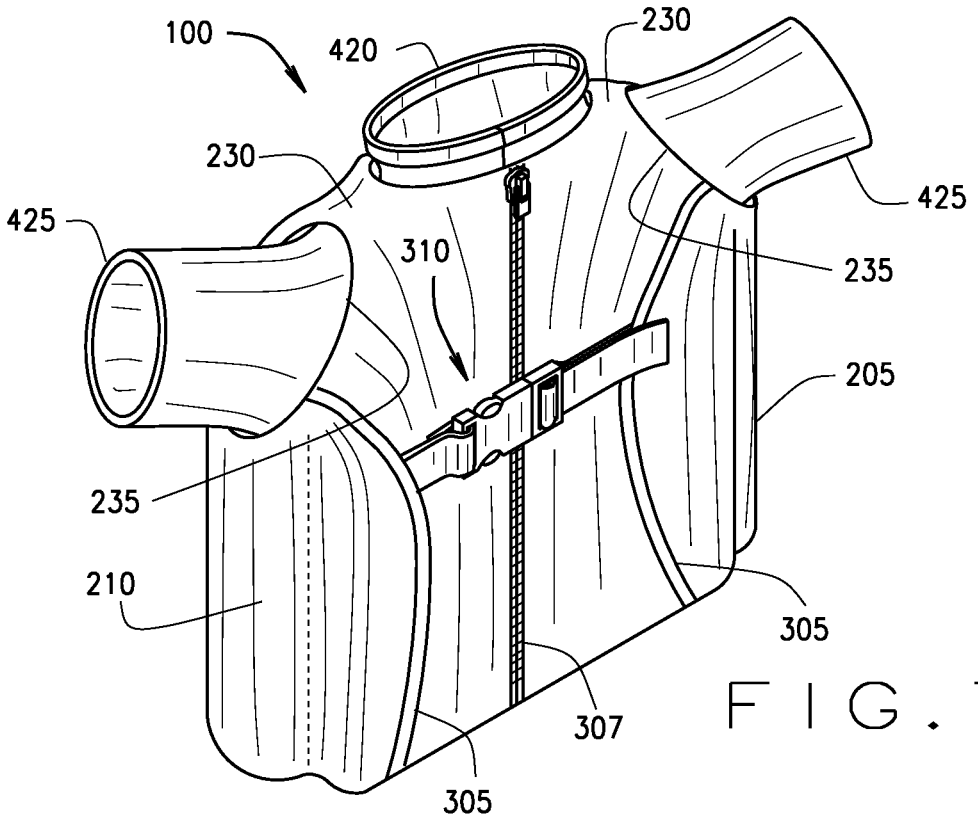
FIG. 7 is a perspective rear view of the life jacket vest of FIGS. 1, 5 and 6 in its closed state.
Figure 8:
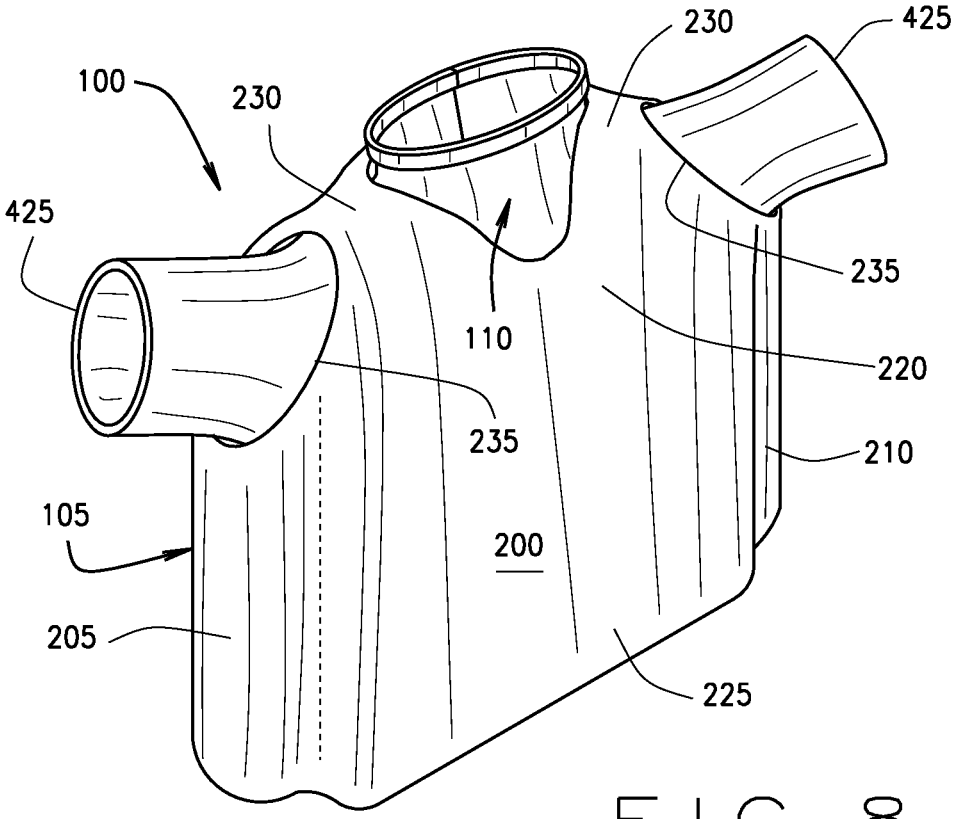
FIG. 8 is a perspective front view of the life jacket vest of FIGS. 1 and 7 in its closed state.

The wearer is able to easily don the life jacket vest with integrated sleeves 100 by inserting an arm into and through each sleeve member 425. Fastener member 307 can then be secured and the fit adjusted using size adjustment member 310 as seen in FIG. 7. Once a person has donned the life jacket vest with integrated sleeves 100, the person has greater mobility and freedom of movement because the lining sleeve members 425 are not attached to arm apertures 235 or to any other portion of life jacket member 105.

From the foregoing, it will be seen that the various embodiments of the present invention are well adapted to attain all the objectives and advantages herein above set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required".

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention.

What is claimed is:

1. A lifejacket vest comprising:

a life jacket member having a front section, a rear section, side sections, and a pair of openings for receiving arms of a wearer; and a lining including a pair of sleeve members and a perimeter, the lining being positioned and located in a permanent mating relationship with at least a portion of the lifejacket member wherein the sleeve members are received and extend through and past the openings of the life jacket member, the lining being attached to the lifejacket member along at least a portion of the perimeter, the lining being detached to the life jacket member at the pair of openings.

2. The life jacket vest of claim 1 wherein the life jacket member includes a fastener member.

3. The lifejacket vest of claim 2 wherein the fastener member is located along at least a portion of the rear section of the life jacket member.

4. The life jacket vest of claim 1 wherein the life jacket member includes a size adjustment member.

5. The life jacket vest of claim 4 wherein the size adjustment member is associated with the rear section of the lifejacket member.

6. The life jacket vest of claim 1 wherein the life jacket member includes a fastener member, and wherein the lining is attached to the life jacket member adjacent to at least a portion of the fastener member.

7. The life jacket vest of claim 1 wherein the perimeter of the lining includes a top portion, a bottom portion, and side portions, the lining being attached to the life jacket member along at least a portion of the side portions of the perimeter.

8. The life jacket vest of claim 1 wherein the perimeter of the lining includes a top portion, a bottom portion, and side portions, the lining being attached to the lifejacket member along at least a portion of the top portion of the perimeter.

9. The life jacket vest of claim 1 wherein the perimeter of the lining includes a top portion, a bottom portion, and side portions, the lining being attached to the life jacket member along at least a portion of the bottom portion of the perimeter.

10. The life jacket vest of claim 1 wherein the sleeve members are long-sleeved.

11. The lifejacket vest of claim 1 wherein the sleeve members are short-sleeved.

12. The life jacket vest of claim 1 wherein the lining is made of an ultraviolet protection factor rated fabric.

13. The life jacket vest of claim 1 wherein the lining includes a neck portion.

14. The life jacket vest of claim 1 wherein the life jacket member includes at least one reinforcing member extending from at least one of said pair of openings to a bottom portion of the life jacket member.

15. A lifejacket vest comprising:

a life jacket member having a front section, a rear section, side sections, a pair of openings for receiving arms of a wearer, and a fastener member located along at least a portion of the life jacket member; and a lining for mating with the lifejacket member, the lining including a front section, a rear section, side sections, a pair of sleeve members, and a perimeter, the lining being positioned and located in mating relationship with the lifejacket member wherein the sleeve members are received and extend through and past the openings of the life jacket member, the lining being permanently attached to the life jacket member along at least a portion of the perimeter, the lining being detached to the life jacket member at the pair of openings.

16. The life jacket vest of claim 15 wherein the lining includes a neck portion.

17. The life jacket vest of claim 15 wherein the life jacket member includes a size adjustment member.

18. The life jacket vest of claim 17 wherein the life jacket member includes an interior space within the front, rear and side sections, at least a portion of the size adjustment member extending within at least a portion of the interior space of the front, side and rear sections.

19. The life jacket vest of claim 15 wherein the lining is attached to the life jacket member adjacent at least a portion of the fastener member.

20. The lifejacket vest of claim 15 wherein the lining is made of an ultraviolet protection factor rated fabric.

* * * * *